United States Patent [19]

Bahr et al.

[11] 4,157,554

[45] Jun. 5, 1979

[54] MULTIPLE-ELECTRODE PRINT HEAD FOR METAL PAPER PRINTERS

[75] Inventors: Dietrich J. Bahr; Karl H. Burckardt, both of Herrenberg, Fed. Rep. of Germany

[73] Assignee: International Business Machines Corporation, Armonk, N.Y.

[21] Appl. No.: 850,122

[22] Filed: Nov. 10, 1977

[30] Foreign Application Priority Data

Nov. 15, 1976 [DE] Fed. Rep. of Germany ..... 2652033

[51] Int. Cl.[2] ..... G03G 17/00

[52] U.S. Cl. ..... 346/163; 346/139 C; 346/162

[58] Field of Search ..... 346/163, 162, 164, 139 C, 346/153, 154, 155; 358/300

[56] References Cited

U.S. PATENT DOCUMENTS

| | | | |
|---|---|---|---|
| 3,429,991 | 2/1969 | Ortlieb | 346/163 |
| 3,541,579 | 11/1970 | Von Hippel | 346/139 C |
| 3,816,839 | 6/1974 | Honda | 346/163 |
| 3,939,482 | 2/1976 | Cotter | 346/139 C |
| 3,999,189 | 12/1976 | Buro | 346/139 C |
| 4,027,311 | 5/1977 | Ambrosio | 346/139 C |

*Primary Examiner*—Jay P. Lucas

*Attorney, Agent, or Firm*—John S. Gasper

[57] ABSTRACT

In a high resolution electroerosion printer, a print head comprises a print head body of plastic or glass in which are embedded closely spaced glass tubes. The glass tubes provide low friction passageways for fine wire electrodes which extend through the glass tubes protruding beyond the print head body to be in uninterrupted flexible contact with the metal layer of a record medium. A pair of feed rolls frictionally engage the individual wires such that when the feed rolls are operated they can adjust the position of the wires to compensate for wear of the ends thereof in contact with the metal layer.

10 Claims, 6 Drawing Figures

FIG.1
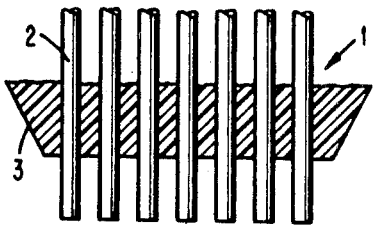
FIG.2
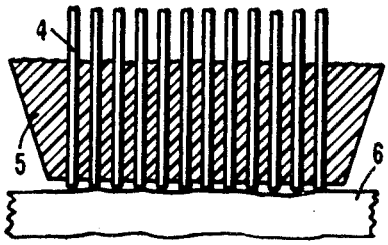
FIG.3
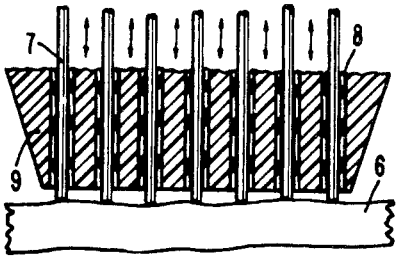
FIG.4
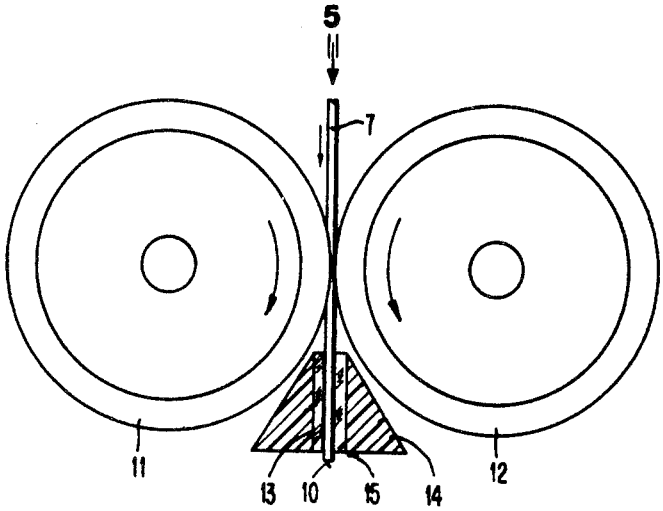
FIG.5
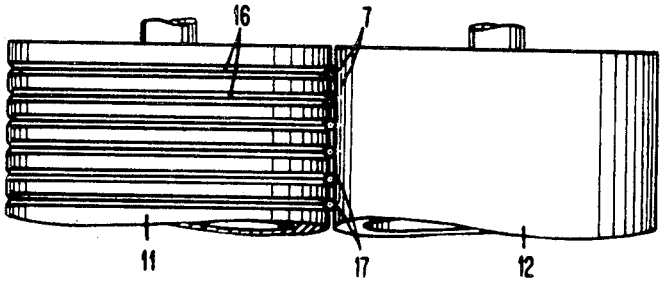
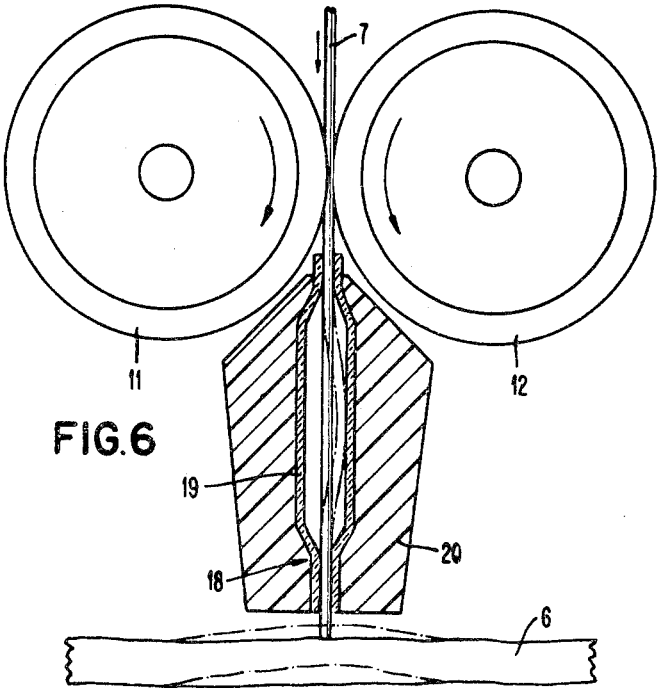
FIG.6

MULTIPLE-ELECTRODE PRINT HEAD FOR METAL PAPER PRINTERS

BACKGROUND OF THE INVENTION

1. Field of the Invention

The invention relates to electroerosion printers and particularly to a print head for metal paper printers with feedable or wear-compensating electrodes flexibly resting on the recording medium.

2. Description of the Prior Art

From German Pat. No. 1,266,030 (U.S. Pat. No. 3,419,886) a print head for metal paper printers is known, whereby the print electrodes are feedably mounted in the print head, flexibly resting under a slight pressure on the recording medium.

The adjusting means described comprise a sheet-metal disk around which an electrode wire is wound, one end of which is clamped in the disk. With one electrode end touching the recording medium, the wire section remote from the disk rests at a particular bending stress against the inside walls of a contact frame, thus ensuring that the electrode wire flexibly rests on the recording medium. If the print electrodes wear on their free end, the electrode wire initially deflects and can be readjusted at particular intervals by manually turning the disk.

As a result of the dimensions of the electrodes used, this arrangement permits only low resolutions. In accordance with the above-mentioned patent, the electrodes are designed as leaf springs. This provides a practicable solution in the case of thicker electrodes. For higher resolutions, i.e. when using electrodes with a small diameter, this solution is impracticable because of the insufficient mechanical strength of the electrodes and their relatively high wear.

It is generally known that electroerosive recording methods for metallized paper as a recording medium require permanent, i.e. uninterrogated, contact between the electrodes and the metal layer. This means that the electrodes are permanently forced to slide across the paper. This sliding and the erosion process connected with the evaporation of parts of the metal layer during printing cause the electrodes to wear. This wear is the greater, the thinner the electrodes. For a low resolution, thicker electrodes (which are mechanically stable) can protrude from the print head body to such an extent that the print head's life suffices for many applications.

Thinner electrodes on the other hand, as are required for higher resolutions, are mechanically unstable and subject to higher wear. Therefore, they have to be embedded nearly up to their printing tip in a non-conductive supporting body of the print head. Total embedding right up to the tip is undesirable, since in such a case permanent contact between electrodes and recording medium would not be ensured as a result of the natural roughness of the latter. (See also FIG. 2.) If the electrodes of the print heads are permitted to protrude from the latter by an amount roughly equalling the electrode strength (to ensure an adequate buckling strength), the life of such print heads is insufficient, since the electrodes wear too rapidly. Even if the material (e.g. plastics) used to embed the electrodes is softer and more highly wearing than the material (molybdenum, tungsten) of which the electrodes are made, additional means have to be employed to ensure that the plastics material wears to such an extent that the electrodes invariably protrude from the print head body by an adequate amount. Therefore, it is necessary to refeed the electrodes according to their wear. This solution has already been employed for low-resolution print heads, i.e. in connection with thick electrodes. For thin electrodes, i.e. high-resolution print heads, such a requirement becomes even more pressing in view of the higher wear.

SUMMARY OF THE INVENTION

To eliminate the above-mentioned disadvantages, it is the object of the invention to provide a high-resolution print head for metal printers, whereby the guiding of the electrodes in the print head and the feeding of the electrodes to compensate for the wear encountered is solved in an advantageous manner.

This problem is solved in accordance with the invention in that the electrodes are guided in thin glass tubes.

In accordance with a further favorable embodiment, the glass tubes can be embedded in a plastics body of the print head or be glass molded.

To ensure that the electrodes are flexible, the glass tubes in accordance with the invention are advantageously expanded in their center portion, whereby the electrodes in this center portion can assume a position deviating from the center line of the glass tube.

In accordance with the invention, two feed rolls are provided for advancing the electrodes, whereby the first feed roll is provided with grooves for guiding the electrodes and is made of a hard material, whereas the second feed roll is made of a soft material.

As materials for these feed rolls the harder acrylonitrile-butadiene-styrene-copolymer and the softer polyurethane can be employed.

A print head arrangement with thin electrodes is always subject to two requirements:

1. The electrodes must be accurately guidable in the print head carrier and be accurately spaced from each other. Because of the accurate positioning of the electrodes, which is necessary at high resolutions, very close tolerances have to be observed.
2. Printing tips of the electrodes protruding from the print head carrier must have dimensions which are below the buckling strength.

The idea to guide the electrodes by means of an aperture mask, whose apertures are mechanically drilled, fails, since it is not possible to drill small holes which are accurately spaced from each other. It is possible, however, to draw glass tubes of corresponding accuracy, which have the additional advantage that their inner walls are smooth. Such thin, accurately calibrated glass tubes are to be used, in accordance with the invention, to guide the electrodes. The smooth inner walls of these glass tubes have the advantage that the wear in the guide is considerably reduced, if not precluded altogether.

Arrangements in accordance with the prior art and embodiments of the invention are shown in the drawings and will be described in detail below.

BRIEF DESCRIPTION OF THE DRAWING

FIG. 1 is a schematic sectional view of a low-resolution print head with protruding electrodes;

FIG. 2 is a sectional view of a high-resolution print head with thin electrodes embedded in plastics;

FIG. 3 is a sectional view of a print head with an aperture mask, whereby the electrodes are guided in thin glass tubes and flexibly rest on the surface of the recording medium;

FIG. 4 shows a print head in accordance with FIG. 3, whereby the electrodes can be refed via feed rolls;

FIG. 5 is a schematic sectional partial view of the feed rolls in the contact area; and FIG. 6 is a schematic sectional view of a print head with thin electrodes guided in glass tubes, whereby the glass tubes are expanded in their center portion and the electrodes can be refed via feed rolls.

DETAILED DESCRIPTION

As seen in FIG. 1, a low-resolution print head 1 has protruding electrodes 2. Low-resolution print heads of this type have thicker electrodes which are relatively stable mechanically and which can protrude from the print head body 3 so far as to adequately increase the print head's life, making it last for many applications.

As seen in FIG. 2, print heads 1 with thinner electrodes 4, which are suitable for a higher resolution, are mechanically unstable and subject to higher wear from surface 6. For the sake of mechanical stability, the electrodes 4 must be embedded almost up to the tip in a non-conductive supporting body 5. Total embedding right up to the tip is undesirable, since in such a case the natural roughness of the recording medium 6 would prevent the necessary permanent contact between electrodes 4 and recording medium 6. If such electrodes 4 were permitted to protrude from the print head body by an amount roughly equalling their strength (while maintaining an adequate buckling strength), the resultant electrode life would be insufficient because of the high wear encountered.

FIG. 3 shows how the electrodes 7 are guided in accordance with this invention in the print head body 9 to eliminate the above-mentioned disadvantage. For reasons of recording accuracy, the electrodes 7 must be accurately guided in the print head body 9 and be accurately spaced from each other within tolerances of several $\mu$m. The direct use of an aperture mask to guide and space the electrodes 7 is eliminated, because it is impossible to drill such small and accurately spaced holes, observing the tolerances mentioned. Accurately calibrated glass tubes 8, on the other hand, can be readily manufactured. Such tubes have the additional advantage that their inner walls are smooth. Therefore, electrodes 7 are guided in adjacent, accurately calibrated glass tubes 8 which are embedded in plastics or glass (FIG. 3). Such a glass tube aperture mask meets all requirements to be fulfilled with regard to the accurate guidance and spacing of the print head electrodes. As already pointed out, glass tubes 8 have the additional advantage that their inner walls are smooth, so that while the electrodes are guided within them the wear encountered is very slight, if not altogether negligible.

Because of the roughness of the recording medium 6 and the wear experienced, the electrodes must be movable in the direction of the double arrows. But the high wear makes it necessary for the electrodes to be refed.

The refeeding of the electrodes 7 is shown in FIG. 4. In this figure the electrode wire is designated as 7. It is guided in the glass tube 13 which is embedded in plastics 14. The printing end of the electrode 7 is designated as 10, the electrode being refed in the direction of the recording medium via a pair of feed rolls 11 and 12, while the latter move in the direction of the arrow. One of the feed rolls 11 is made of a harder material, e.g. acrylonitrile-butadiene-styrene-copolymer, whereas the other 12 is made of a softer material, such as polyurethane. To guide the electrodes, the harder roll 11 is provided with corresponding grooves 16 (FIG. 5). FIG. 5 shows a view of the rolls in the direction 5 (FIG. 4) in the contact area. The harder roll in FIG. 5 is again designated as 11 and the soft roll as 12. The guide grooves 16 in the hard roll 11 serve to guide the electrodes 7. When the rolls touch each other at the appropriate pressure, the electrodes at points 17 facing the grooves 16 are pressed slightly into the soft roll 12.

Electrodes 7 are electrically contacted via the hard roll 11 which for this purpose is annularly provided with a conductive layer in the area of grooves 16. The conductive groove layer is energized via sliding contacts (not shown). This solution eliminates the expensive electroplating of the electrode ends, as would be required for soldered joints. In addition, it permits using electrodes of almost unlimited length. To ensure that the electrodes are refed before the image quality becomes noticeably poor, a contact point 15 (see FIG. 4) is arranged near the electrode tips. When the electrode wear reaches a certain degree, this contact point touches the surface of the metal paper, generating a signal. This signal, in the form of a burning lamp or the like, induces the operator to manually refeed the electrodes. The signal can also be used to move the print head carrier out of the printing area, whereby a ratchet wheel attached to the hard roll is rotated via an arm, through a particular angle in the direction of the arrow (FIG. 4). In this manner the electrodes are refed fully automatically.

As mentioned above, each of the electrodes must be flexibly mounted to ensure good contact between the electrodes 7 and to compensate the roughness of the metal paper 6 surface. FIG. 3 is a sectional view of the electrodes guided in glass tubes and which can be flexibly moved in the direction of the double arrow to compensate the waviness of the paper surface.

From the art flexibly arranged electrodes are known. According to one such embodiment of flexibly arranged electrodes, which are used for low-resolution print heads, the electrodes are designed as leaf springs. Such a leaf spring is fixed to its holder and at its printing end is bent at right angles to the recording surface. The leaf spring electrode rests under a bias on the recording medium and thus is capable of accommodating the paper roughness. The wear on the printing tip of the electrode is compensated by the bias of the electrode which continues to rest on the surface of the metal paper. However, such a solution is impracticable for high-resolution print heads, i.e. for electrodes of a small diameter (less than 0.1 mm), since the mechanical stability of such thin electrodes which are subject to relatively high wear is insufficient. As the elongation is relatively small because of the limited roughness of the paper $<15\mu$, the glass tubes used to guide the electrodes ensure that the latter rest flexibly on the surface of the recording medium. FIG. 6 shows how the glass tube 18 used to guide the electrode 7 and embedded in plastics 20 is expanded in its center portion 19. This expansion 19 permits electrode 7 to assume two extreme positions. In one extreme position the electrode extends along the centerline of the glass tube (full lines) and in the other extreme position it assumes the dash-dotted position, resting against the wall of the expanded portion of the glass tube at one point. When pressure is exerted on the tip of the electrode, the electrode in the center part of the glass tube, which is represented by full lines, can move towards the outside, until, in an extreme case, it assumes the position marked by dash-dotted lines. The diameter of the expanded center part of the glass tubes must be such that the elastic deformation of the tip between the two extreme positions of the electrode wire can be accommodated by the center part of the glass tube. However, the diameter is limited by the fact that the electrodes must not buckle when the electrode wire is laterally bent. The lateral bending of the electrode wire must be within its elastic limit, so that the electrode in the unloaded state returns to the original position marked by full lines. The shape of the expanded center portion is best adapted to the elasticity of the electrode wire. The electrode wire is refed by means of the feed rolls shown in FIG. 4. Because of the continuous relative movement between the electrodes and the inner faces of the glass guides it is essential that the glass surface is absolutely smooth. This minimizes or eliminates the extent of wear encountered.

As the electrode wire can be laterally bent, which produces a spring effect, the pressure at which the electrode is pressed against the recording medium can be suitably adjusted, thus considerably reducing the risk of the electrode marking the surface of the recording medium.

The electrode tips are coarsely cleaned from printing deposits, etc. by means of a brush which is used outside the printing area and which is passed by the print head once per printed page, removing any impurities that have accumulated.

While the invention has been particularly shown and described with reference to a preferred embodiment thereof, it will be understood by those skilled in the art that various changes in form and details may be made therein without departing from the spirit and scope of the invention.

We claim:

1. In a high resolution electroerosion printer,
the combination comprising a print head having a set of flexible electrode wires for recording by burning a pattern representing data symbols in a metal layer of a metal paper medium, and
support means for flexibly maintaining the ends of said set of wires in uninterrupted contact with said metal layer during recording including
individual glass guide tubes for each of said wires, said wires being movable through said guide tubes so as to have an end protruding beyond the end of said guide tubes to flexibly contact said metal layer,
said guide tubes providing lateral support to limit bending of said wire in the vicinity of said protruding ends thereof, and
a print head body for fixedly holding the relative spacing of said guide tubes in a fixed array for recording said pattern, and
means for compensating for wear of said protruding ends of said wires comprising means operable for feeding said wires through said guide tubes for flexibly maintaining said protruding ends of said individual wires in uninterrupted contact with said metal layer.

2. In a high resolution electroerosion printer, a print head in accordance with claim 1 in which said guide tubes are thin glass tubes.

3. In a high resolution electroerosion printer, a print head in accordance with claim 2 in which said print head body is plastic and said glass tubes are embedded therein.

4. In a high resolution electroerosion printer, a print head in accordance with claim 2 in which said print head body is glass and said glass tubes are embedded therein.

5. In a high resolution electroerosion printer, a print head in accordance with claim 2 in which said glass tubes are expanded in their center part so that said electrodes can assume a flexible position within said glass tubes deviating from the center line of the glass tubes.

6. In a high resolution electroerosion printer, a print head in accordance with claim 1 in which said guide tubes are expanded in their center part so that said electrodes can assume a flexible position within said guide tubes deviating from the center line of said guide tubes.

7. In a high resolution electroerosion printer, a print head in accordance with claim 6, in which said expanded center part limits lateral bending of said electrodes so as to remain within their elastic limit.

8. In a high resolution electroerosion printer, the combination in accordance with claim 1 in which
said means for feeding said electrodes comprises a pair of feed rolls adapted to frictionally engage the surface of said electrodes for moving said electrodes through said guide tubes so as to protrude therefrom into contact with the metal layer of said record medium,
one of said feed rolls being provided with grooves in the periphery thereof for guiding said electrodes,
said one of said feed rolls being made of hard material,
said other feed roll in engagement with said electrodes being made of soft material.

9. In a high resolution electroerosion printer, the combination in accordance with claim 8 in which one of said feed rolls is made of acrylonitrile-butadiene-styrene-copolymer and the other of said rolls is made of polyurethane.

10. In a high resolution electroerosion printer, the combination in accordance with claim 8 in which conductor means is provided in said grooves for making electrical contact with said electrodes.

* * * * *